US007004661B2

(12) United States Patent
Gradi

(10) Patent No.: US 7,004,661 B2
(45) Date of Patent: Feb. 28, 2006

(54) BALLPOINT PEN NIB PROVIDED WITH A STEM WITH COMMUNICATION FLUTES

(75) Inventor: Renzo Gradi, Lugano (CH)

(73) Assignee: Premec S.A., Cadempino (CH)

( * ) Notice: Subject to any disclaimer, the term of this patent is extended or adjusted under 35 U.S.C. 154(b) by 0 days.

(21) Appl. No.: 10/495,169

(22) PCT Filed: Feb. 13, 2003

(86) PCT No.: PCT/IB03/00503

§ 371 (c)(1),
(2), (4) Date: May 11, 2004

(87) PCT Pub. No.: WO2004/054815

PCT Pub. Date: Jul. 1, 2004

(65) Prior Publication Data

US 2004/0258458 A1 Dec. 23, 2004

(30) Foreign Application Priority Data

Dec. 17, 2002 (CH) ..... 2146/02

(51) Int. Cl.
*B43K 7/10* (2006.01)
*B43K 7/02* (2006.01)

(52) U.S. Cl. ..... 401/217; 401/216

(58) Field of Classification Search ..... 401/208, 401/209, 211–214, 216, 217
See application file for complete search history.

(56) References Cited

U.S. PATENT DOCUMENTS

| | | | | |
|---|---|---|---|---|
| 3,945,735 A | | 3/1976 | Nakashiki et al. | 401/216 |
| 3,947,137 A | * | 3/1976 | Hori | 401/217 |
| 4,430,014 A | * | 2/1984 | Tsai | 401/216 |
| 4,457,644 A | * | 7/1984 | Yokosuka | 401/216 |
| 4,842,433 A | * | 6/1989 | Otsuka | 401/209 |

FOREIGN PATENT DOCUMENTS

| | | |
|---|---|---|
| DE | 24 43 888 | 4/1979 |
| GB | 2 065 565 | 7/1981 |

* cited by examiner

*Primary Examiner*—David J. Walczak
(74) *Attorney, Agent, or Firm*—Young & Thompson

(57) ABSTRACT

A ballpoint pen (1) nib (2) housing the ball (3) and having a stem (6), at least one part of which is inserted coaxially into a hole (5) in the lower end (4*f*) of a hollow barrel (4) forming part of the ballpoint pen (1). On the outer surface of the at least one part of the stem are formed one or more flutes (7*i*) that extend parallel to the longitudinal axis (Z—Z) of the stem (6) for a length (L) equal to or greater than the axial length (H) of the hole (5) in such a way that the opposite ends (D, E) of the abovementioned flutes (7*i*) are outside of it and on opposite sides with respect to it.

8 Claims, 3 Drawing Sheets

BALLPOINT PEN NIB PROVIDED WITH A STEM WITH COMMUNICATION FLUTES

CROSS REFERENCE TO RELATED APPLICATION

This is the 35 USC 371 national stage of international application PCT/IB03/00503 filed on 13 Feb. 2003, which designated the United States of America.

FIELD OF THE INVENTION

The field of the present invention is that of nibs for ballpoint pens, that is more specifically those parts, housing the writing ball, which are provided with a stem which is inserted coaxially into a hole in the lower end of the hollow barrel forming part of a ballpoint pen.

BACKGROUND OF THE INVENTION

As is well known, to ensure a continuous supply of ink from a reservoir (or refill) inside the said hollow barrel, connected to the nib, air must be allowed to enter this barrel from the outside so that the gradual outflow of ink during writing does not result in a vacuum that would prevent that outflow. In the prior art this is achieved by making a hole through the wall of the hollow barrel, or making the above-described hole at the lower end of the barrel slightly larger than the part of the stem housed within it, in order to create a clearance which will leave a large enough gap for air to enter.

While the first approach raises aesthetic problems which may be incompatible with the quality image of ballpoint pens of a certain value, the second approach is detrimental both to the precision of the writing action (the nib tends to move inside the hole while writing) and the impression of careful workmanship and sturdiness and reliability of the ballpoint pen which a user may perceive.

Another problem relating to the manufacture of ballpoint pens is how to cool the nibs as quickly as possible while they are being stamped, sized, drilled etc.

Because of the fast production rates demanded in the processing of nibs for ballpoint pens, which are details with low added value, even a very small lengthening of the processing cycle time of each individual nib has significant repercussions on production costs.

SUMMARY OF THE INVENTION

The inventor of the present innovation has devised a ballpoint pen nib in which both of the problems described above are overcome: on the outer surface of the part of the stem of the nib which is to be housed in the above-described hole formed in the lower end of the barrel are formed one or more flutes that extend parallel to the longitudinal axis of the stem for a length equal to or preferably greater than the axial length of the said hole.

By fitting the nib into the latter, provided care is taken to ensure that the opposite ends of the said flutes are outside of it and on opposite sides with respect to it, one or more passages will be created, allowing the free passage of air under all conditions. There may be one or more than one of these flutes and they may describe paths different to the said axis of the stem, as will be explained later. They may also take the form of helical flutes.

Forming these flutes at an early stage in the production of a ballpoint pen nib will also provide one or more communication channels for the cooling of the nibs, and in particular also of the part of the nib which is gripped by clamps or the like in the course of manufacture. The existence of these flutes, above all, increases the surface area allowing the exchange of heat between all parts of the nib and the fluid (air, oil etc.) used to cool them.

BRIEF DESCRIPTION OF THE DRAWINGS

A more detailed description will now be given of a preferred illustrative embodiment of a nib according to the invention, reference also being made to the appended drawings, in which.

DETAILED DESCRIPTION OF THE INVENTION

Figure 3:
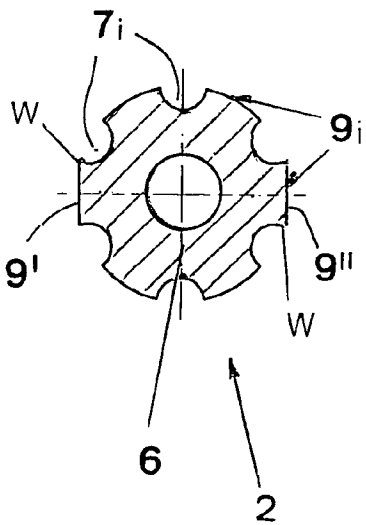
FIG. 3 shows a cross section of the nib shown in FIGS. 1 and 2.
Figure 2:
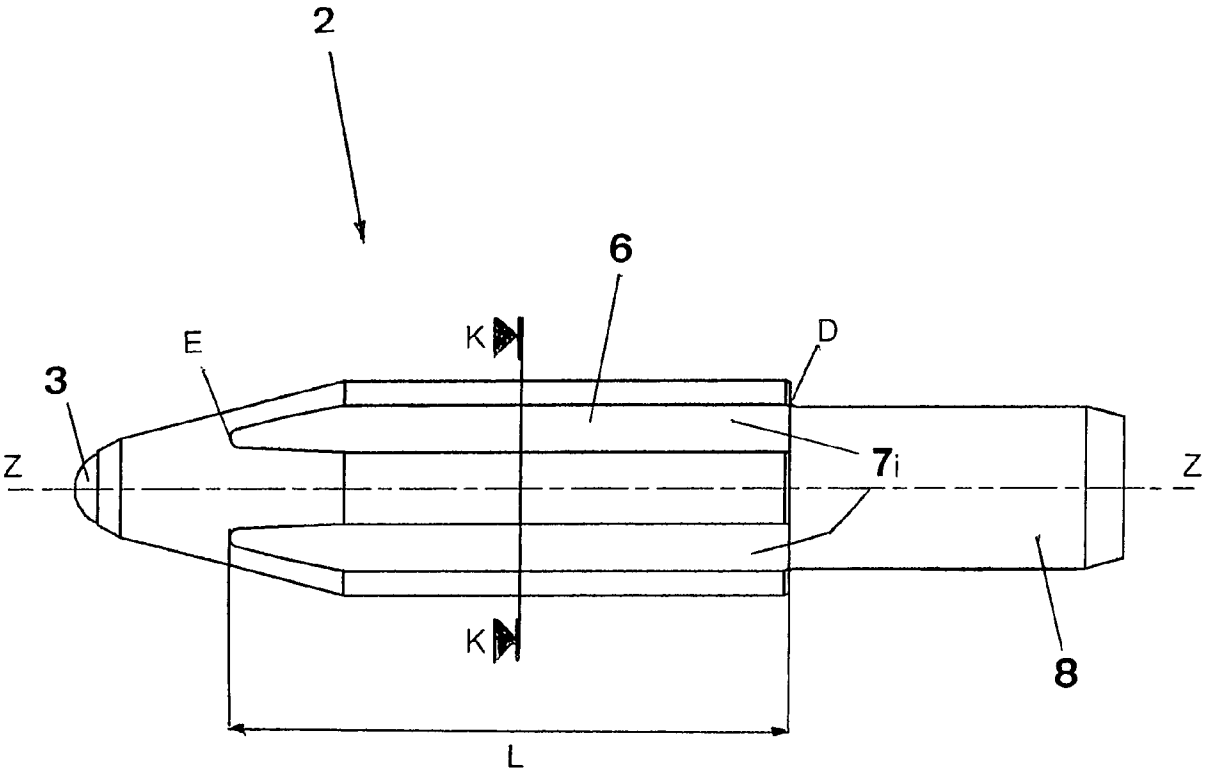
FIG. 2 shows a side view of that part of the stem of the nib of FIG. 1 on which a number of radial flutes are formed.

Referring initially to FIGS. 2 and 3, which show a ballpoint pen nib 2 according to the invention, it can be seen that this nib 2 has an elongated body, which as usual houses the ball 3 at its pointed end, comprises a stem 6 having a narrow tail 8 for the application by known methods of the ink reservoir (not shown). A number of radial flutes 7*i* are formed on the outer surface of the said stem 6 parallel to the axis Z—Z of this stem 6, extending for a length L.

Figure 1:
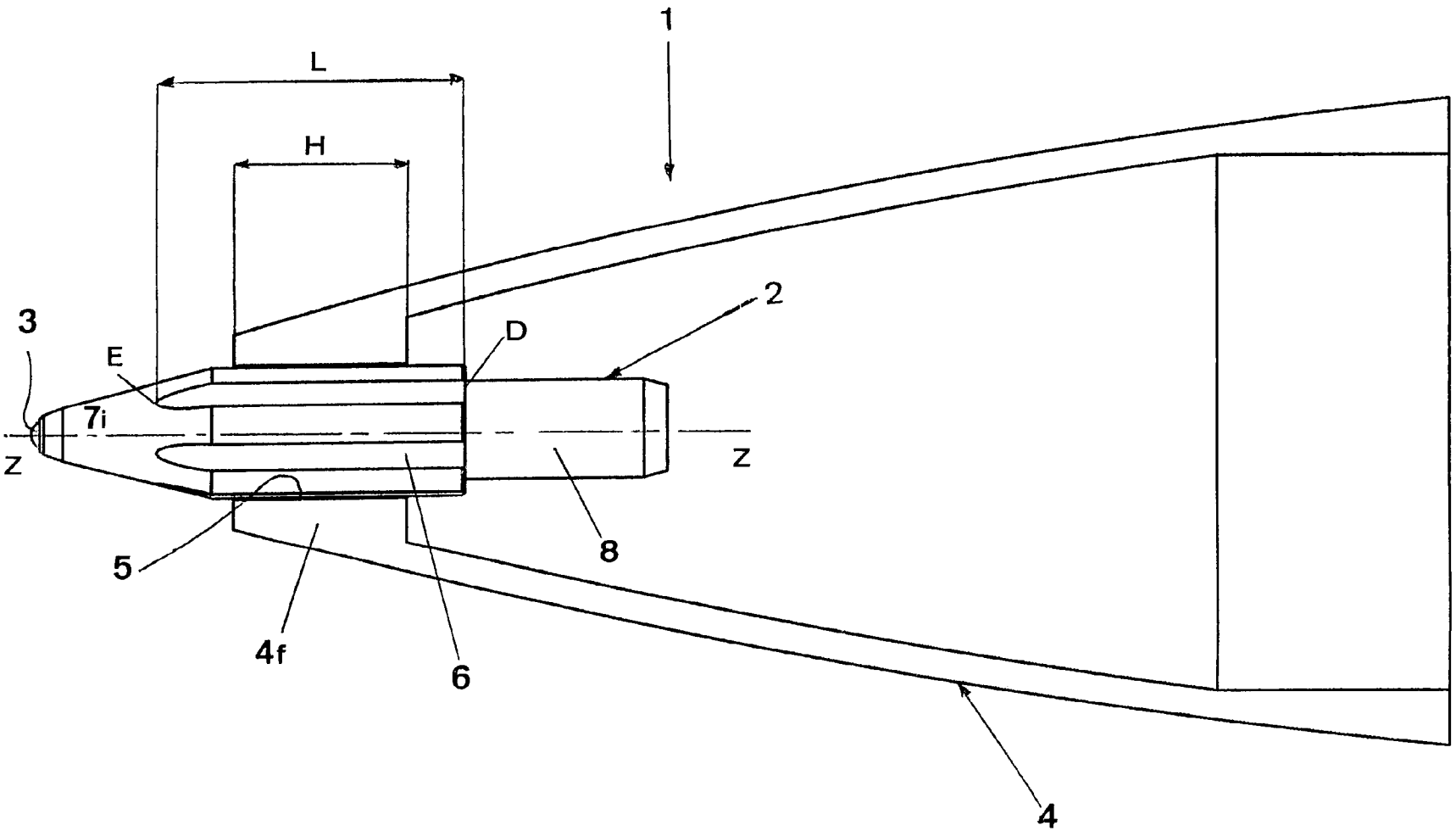
FIG. 1 is a longitudinal section through part of a ballpoint pen with the nib of the invention fitted into its hollow barrel.

The nib shown in FIGS. 2 and 3 is fitted into the hollow barrel 4, as shown in FIG. 1, by coaxial male/female insertion of the part of its stem containing the said flutes 7*i* into a cylindrical hole 5 with which a lower end 4*f* of the hollow barrel 4 of the ballpoint pen 1 is provided.

The axial length H of the abovementioned cylindrical hole 5 is less than the abovementioned length L of the flutes 7*i*, and the nib 2 is fitted into the hollow barrel 4 in such a way that the ends D, E of these flutes 7*i* are outside of the cylindrical hole 5, and on opposite sides with respect to it. In this way the interior of the hollow barrel 4 is in communication with the external environment through a number of channels formed by the above-described flutes 7*i*, which let air in to compensate for the volume of ink flowing towards the ball 3 during writing without any vacuum developing.

In the example shown in the drawings the flutes 7*i* are arranged radially, and the profile of their cross section is an arc of a circle, but other arrangements and other shapes of the profile may freely be used. In the case in question, furthermore, the flutes are parallel to the longitudinal axis Z—Z of the stem 6, but they could also describe some different path.

As noted earlier, the existence of the flutes 7*i* significantly increases the surface area allowing the exchange of heat between the outer surface of the nib 2 and the coolant used in the course of its manufacture. According to the invention, furthermore, in order to make the clamping of the nib in the various phases of manufacture more reliable, at least two 9', 9"(FIG. 3) of the portions 9*i* of the outer surface of the said stem 6 that join the ends of the profiles of two adjacent flutes 7*i* are made flat.

The inventor also specifies the still more advantageous possibility of thus flattening all the portions 9*i* mentioned above. Giving the nib an even number of such portions 9*i* means that any pair of these can be gripped securely irrespective of the orientation of the workpiece. The insertion of a nib produced in this way (not shown in the drawings) into the said cylindrical hole 5 still produces a male/female fit, because it presses on the inner surface of the hole 5 via the edges W (FIG. 3) created by the intersection of the portions 9*i* and the flutes 7*i*.

Figure 4:
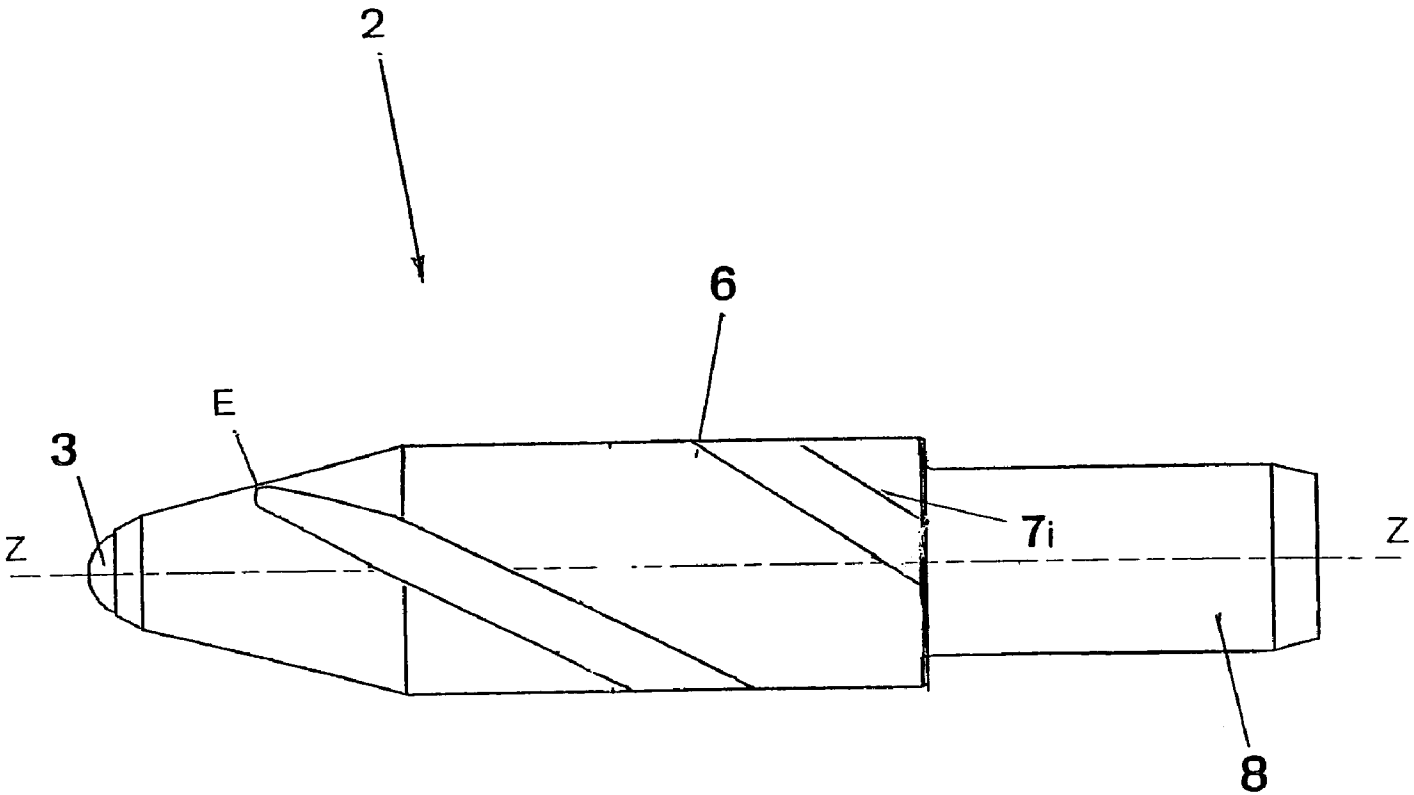
FIG. 4 shows a side view of another embodiment of the invention.

As noted earlier, in the ballpoint pen nib of the invention the outer surface of at least part of its stem may also possess one or more helical flutes or grooves, their ends being located as explained in the first case. This example is illustrated in FIG. 4 of the drawings.

In this discussion and in the figures, the other parts of a ballpoint pen 1 to which the nib 2 of the invention is fitted, including the reservoir, have not been detailed as they are well known to those skilled in the art and require no further explanation.

What is claimed is:

1. Ballpoint pen (1) nib (2) housing a ball (3) and having a stem (6), at least one part of which is inserted coaxially into a hole (5) in the lower end (4*f*) of a hollow barrel (4) forming part of the ballpoint pen (1), wherein on the outer surface of the at least one part of the stem are formed one or more flutes (7*i*) that extend parallel to the longitudinal axis (Z—Z) of the stem (6) for a length (L) equal to or greater than the axial length (H) of the hole (5) in such a way that opposite ends (D, E) of the flutes (7*i*) are on opposite sides with respect to the hole; and at least two (9', 9") of the portions (9*i*) of the outer surface of the stem (6) joining the ends of the profiles of two adjacent flutes (7*i*) are essentially flat.

2. Ballpoint pen nib according to claim 1, wherein the flutes (7*i*) are radial and the profile of their cross section is an arc of a circle.

3. Ballpoint pen nib according to claim 2, wherein at least two (9', 9") of the portions (9*i*) of the outer surface of the stem (6) joining the ends of the profiles of two adjacent flutes (7*i*) are essentially flat.

4. Ballpoint pen nib according to claim 1, wherein a single helical flute or groove is formed on the outer surface of the stem (6).

5. A ballpoint pen nib, comprising:

an elongated body extending in a longitudinal direction from a first end to an opposite second end;

said body having an outer peripheral surface, and an internal ink passage extending between the first end and the second end;

said first end housing a ball;

said second end being structured and arranged to be joined to an ink reservoir, such that the first end communicates with the ink reservoir via said internal ink passage; and a plurality of air grooves arranged radially on the outer peripheral surface, and the profile of their cross-section is an arc of a circle; said air grooves having a central axis which is parallel to the longitudinal direction of the body.

6. The ballpoint pen nib according to claim 5, wherein the nib has one part which is structured and arranged to be inserted into a hole in a lower end of a hollow barrel of a ballpoint pen, with the ends of the at least one air groove being on opposite sides of the hole, such that the interior of the hollow barrel communicates with the external environment via the at least one air groove.

7. The ballpoint pen nib according to claim 5, wherein at least two of the portions of the outer peripheral surface of the body joining the ends of the profiles of two adjacent air grooves are substantially flat.

8. The ballpoint pen nib according to claim 5, wherein the air grooves are helical.

* * * * *